US010263358B2

(12) United States Patent
Wu et al.

(10) Patent No.: US 10,263,358 B2
(45) Date of Patent: Apr. 16, 2019

(54) CONNECTOR MODULE HAVING A DETACHABLE FLOATING CONNECTOR ASSEMBLY

(71) Applicant: FOXCONN INTERCONNECT TECHNOLOGY LIMITED, Grand Cayman (KY)

(72) Inventors: Jerry Wu, New Taipei, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/849,625

(22) Filed: Dec. 20, 2017

(65) Prior Publication Data

US 2018/0175540 A1 Jun. 21, 2018

(30) Foreign Application Priority Data

Dec. 20, 2016 (CN) ..... 2016 1 1185674

(51) Int. Cl.

| | |
|---|---|
| ***H01R 13/502*** | (2006.01) |
| ***H01R 13/514*** | (2006.01) |
| ***H01R 13/518*** | (2006.01) |
| ***H01R 13/631*** | (2006.01) |

(52) U.S. Cl.

CPC ..... *H01R 13/514* (2013.01); *H01R 13/6315* (2013.01); *H01R 13/502* (2013.01); *H01R 13/518* (2013.01)

(58) Field of Classification Search

CPC ..... H01R 13/518; H01R 13/6315; H01R 13/514; H01R 13/502

USPC ..... 439/540.1, 535, 247, 248

See application file for complete search history.

(56) References Cited

U.S. PATENT DOCUMENTS

| | | | | |
|---|---|---|---|---|
| 5,352,133 | A * | 10/1994 | Sampson | H01R 13/6271 439/357 |
| 5,676,569 | A * | 10/1997 | Davis | H01R 13/518 439/540.1 |
| 6,986,676 | B1 * | 1/2006 | Tronolone | H01R 13/514 439/247 |
| 7,175,479 | B1 * | 2/2007 | McAlonis | H01R 13/6275 29/750 |
| 7,195,519 | B1 * | 3/2007 | McAlonis | H01R 13/518 439/607.39 |
| 7,347,745 | B1 * | 3/2008 | Raudenbush | H01R 13/4223 439/595 |

(Continued)

*Primary Examiner* — Gary F Paumen

(74) *Attorney, Agent, or Firm* — Wei Te Chung; Ming Chieh Chang

(57) ABSTRACT

A connector module (100) includes a base (1) including a front face (101), a rear face (102) opposite to the front face, a top face (103) connecting the front face and the rear face, and a mounting slot (104) extending through the front face and the rear face; a first connector assembly (2) mounted on the base; a second connector assembly (3) mounted on the base through the mounting slot along a rear to front direction, and extending beyond the front face for being mated with a mating connector; and a block member (4) mounted on the base with a portion projected into the mounting slot to block a rear end of the second connector assembly to prevent the second connector assembly from withdrawing from the base.

20 Claims, 11 Drawing Sheets

(56) References Cited

U.S. PATENT DOCUMENTS

| | | | | |
|---|---|---|---|---|
| 8,579,519 | B2 * | 11/2013 | Wu | G02B 6/3817 385/101 |
| 8,632,351 | B2 * | 1/2014 | Wu | H01R 13/6315 439/248 |
| 9,997,879 | B2 * | 6/2018 | Zhang | H01R 27/02 |
| 2005/0164548 | A1 * | 7/2005 | Spears | G06F 1/182 439/540.1 |
| 2007/0249223 | A1 * | 10/2007 | Sakamoto | H01R 13/5221 439/552 |
| 2009/0004922 | A1 * | 1/2009 | Daugherty | H01R 13/514 439/660 |
| 2009/0317999 | A1 * | 12/2009 | Arts | H01R 13/6315 439/248 |
| 2012/0238133 | A1 * | 9/2012 | Cao | H01R 13/514 439/571 |
| 2017/0012386 | A1 * | 1/2017 | Tseng | H01R 13/5825 |

* cited by examiner

CONNECTOR MODULE HAVING A DETACHABLE FLOATING CONNECTOR ASSEMBLY

BACKGROUND OF THE INVENTION

1. Field of the Invention

The present invention relates to a connector module, and more particularly to a connector module having variations of use.

2. Description of Related Arts

U.S. Pat. No. 8,632,351, issued on Jan. 21, 2014 to Wu, discloses a connector module comprising a base, a first connector assembly mounted on the base, and a second connector assembly mounted on the base and disposed spaced apart from the first connector assembly. The second connector assembly is floating with respect to the base for easy mating with a mating connector. Both of the first connector assembly and the second connector assembly are fixed on the base such that they cannot be independently used.

Hence, an improved connector module is desired to offer advantages over the related art.

SUMMARY OF THE INVENTION

An object of the present invention is to provide a connector module having variations of use.

To achieve the above-mentioned object, a connector module comprises a base comprising a front face, a rear face opposite to the front face, a top face connecting the front face and the rear face, and a mounting slot extending through the front face and the rear face; a first connector assembly mounted on the base; a second connector assembly mounted on the base through the mounting slot along a rear to front direction, and extending beyond the front face for being mated with a mating connector; and a block member mounted on the base with a portion projected into the mounting slot to block a rear end of the second connector assembly to prevent the second connector assembly from being withdrawn from the base.

According to the present invention, the second connector assembly is detachably mounted on the base. Therefore, the second connector assembly can be used independently or together with the first connector assembly.

DETAILED DESCRIPTION OF THE PREFERRED EMBODIMENT

Reference will now be made in detail to a preferred embodiment of the present invention.

Figure 1:
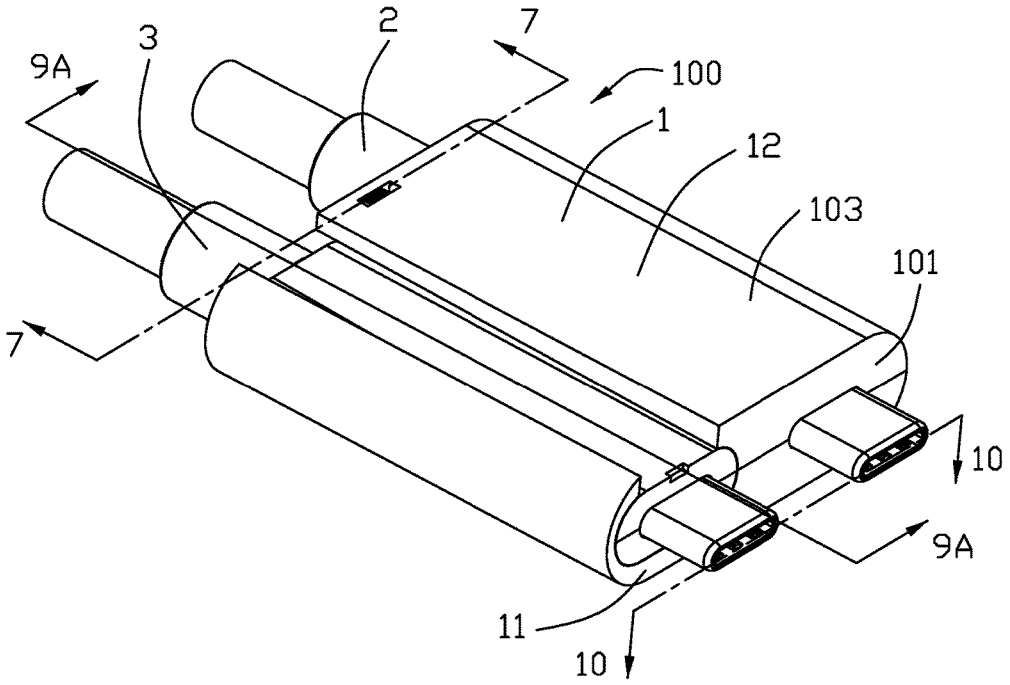
FIG. 1 is a perspective view of connector module in accordance with present invention.
Figure 2:
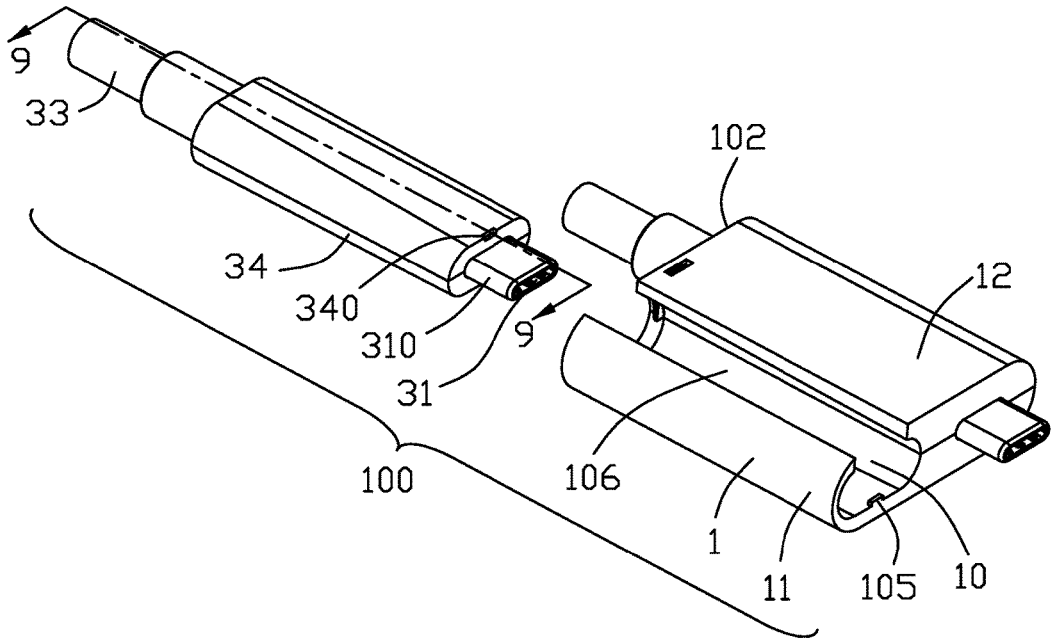
FIG. 2 is a part of exploded view of the connector module as shown in FIG. 1.
Figure 3:
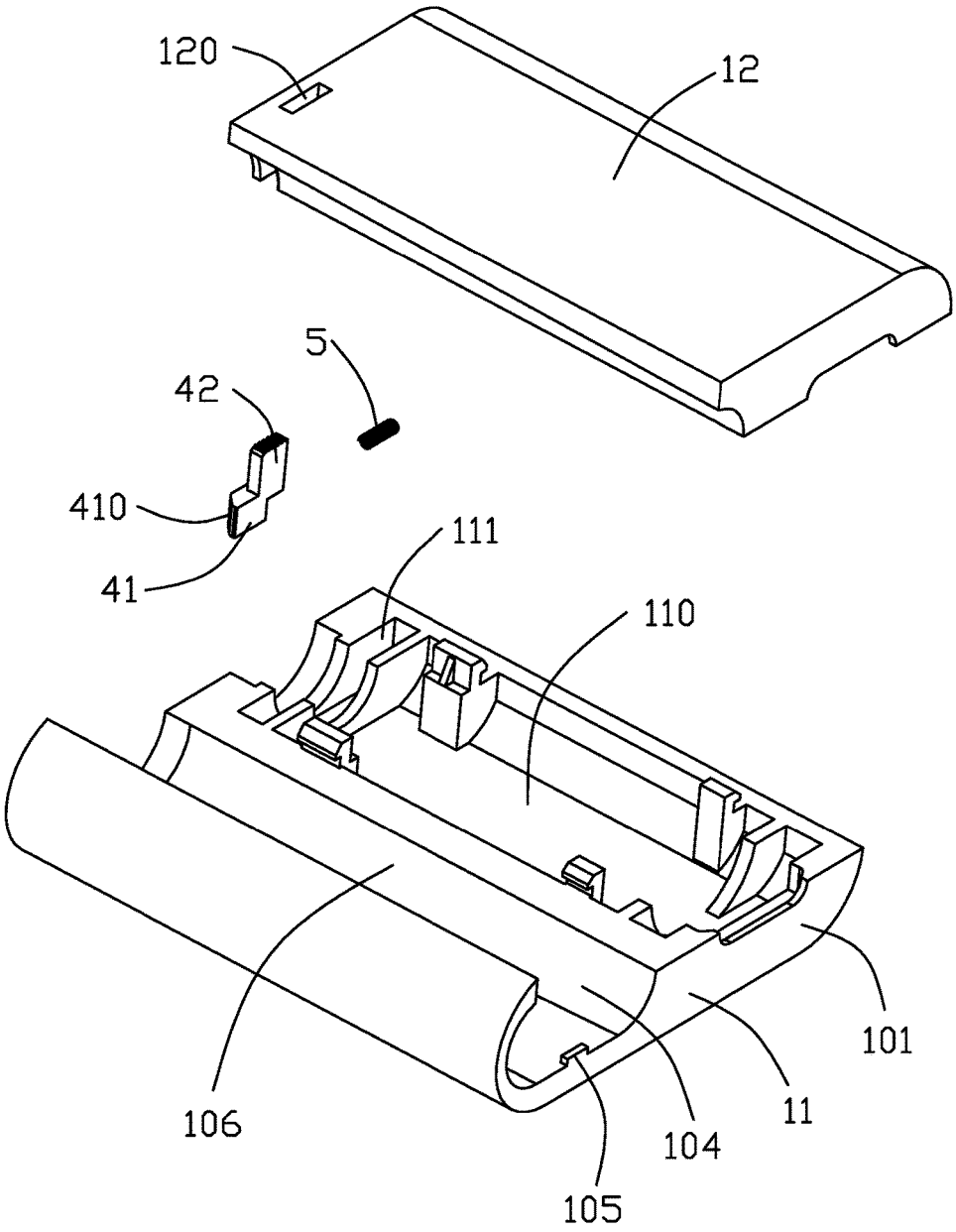
FIG. 3 is an exploded view of a base of the connector module as shown in FIG. 1.
Figure 4:
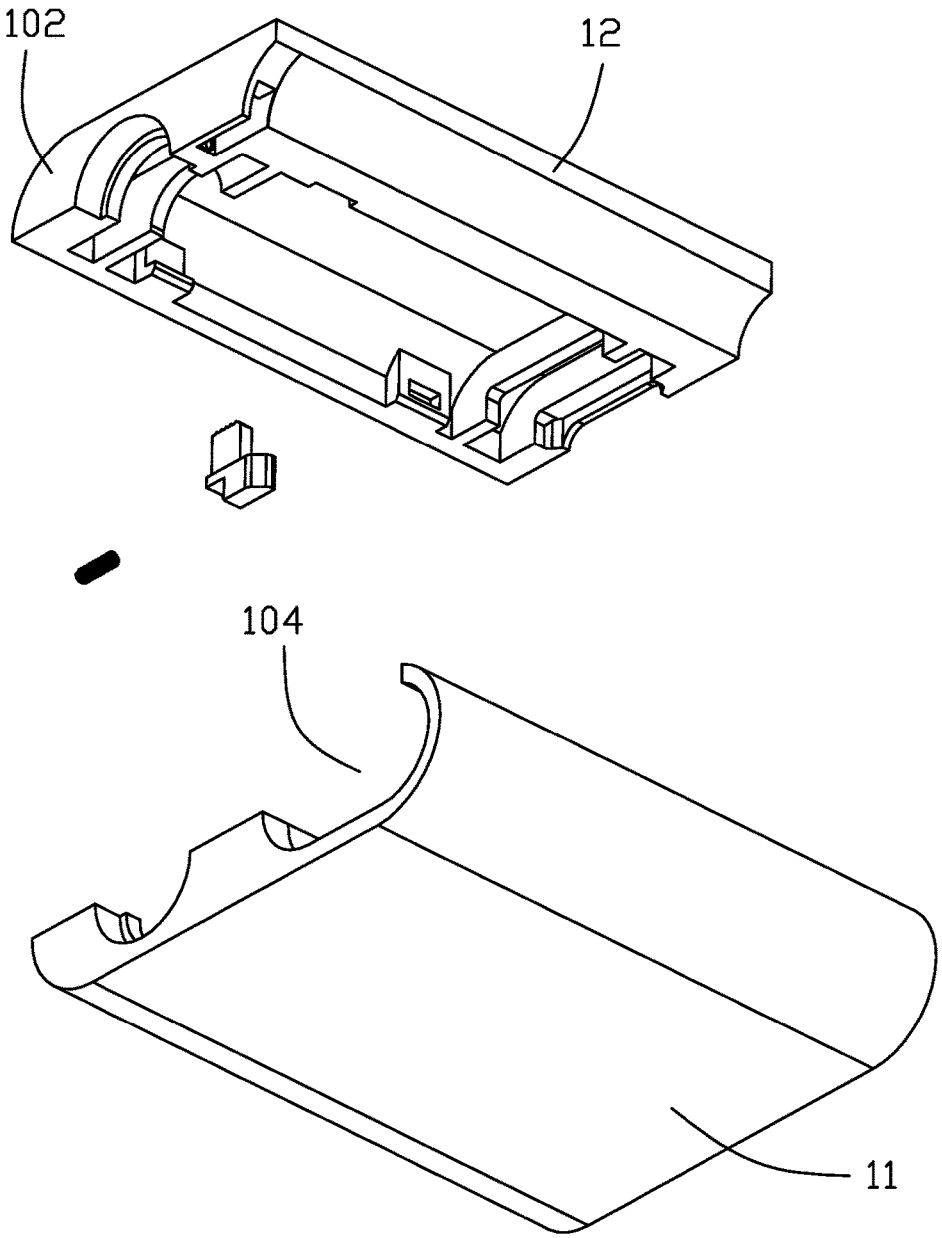
FIG. 4 is another exploded view of the base of the connector module as shown in FIG. 3.
Figure 5:
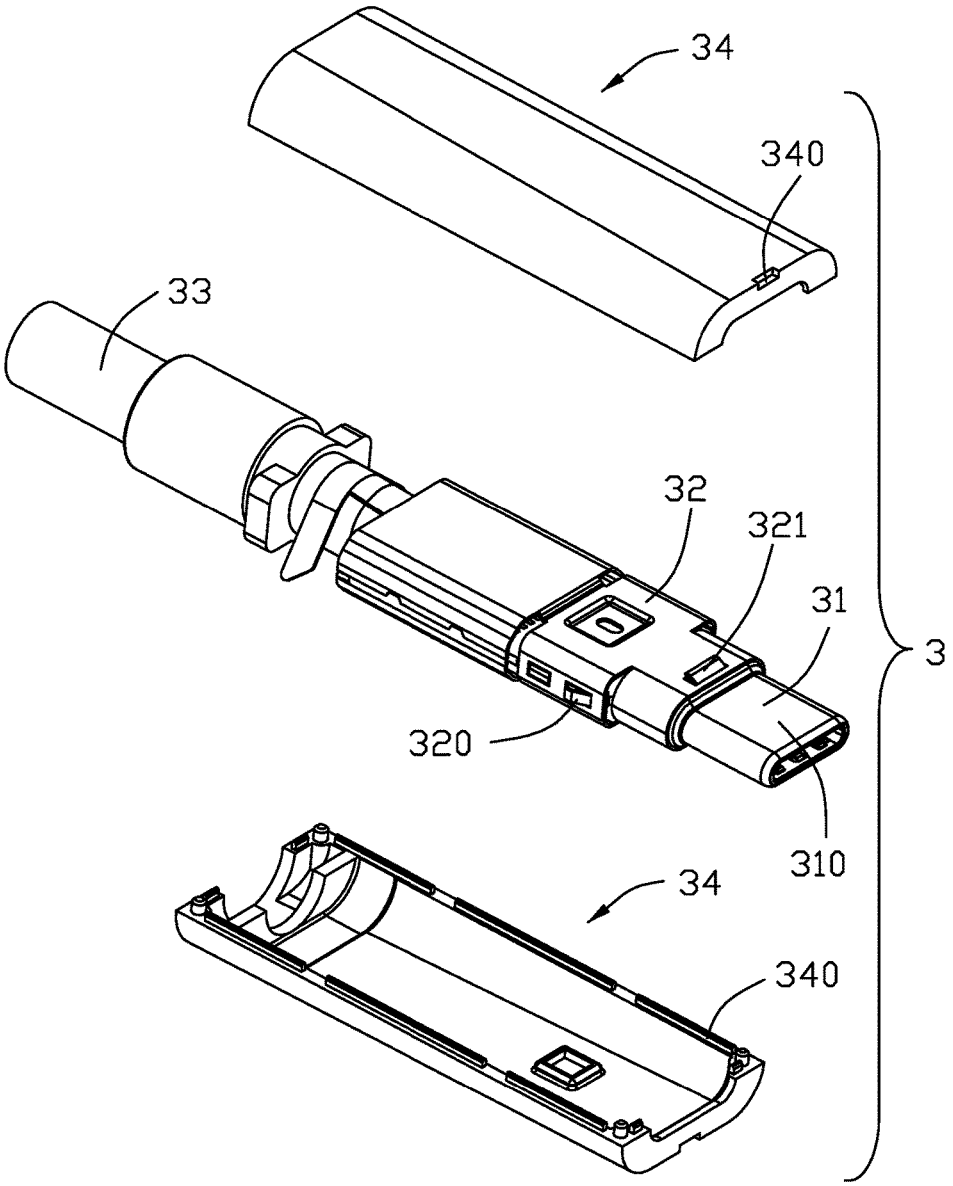
FIG. 5 is a part of exploded view of a second connector assembly of the connector module as shown in FIG. 1.
Figure 6:
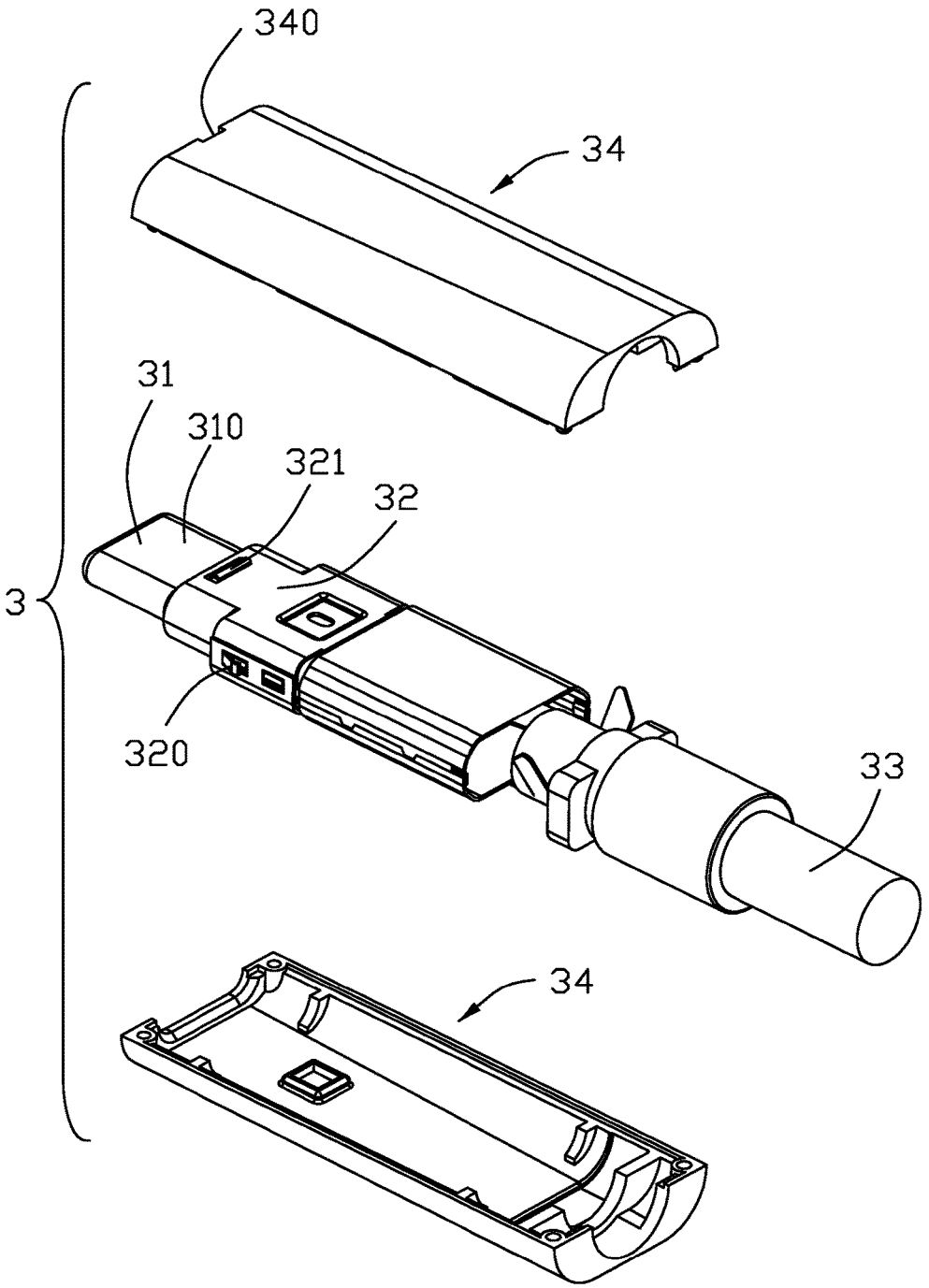
FIG. 6 is another part of exploded view of the connector module as shown in FIG. 5.
Figure 7:
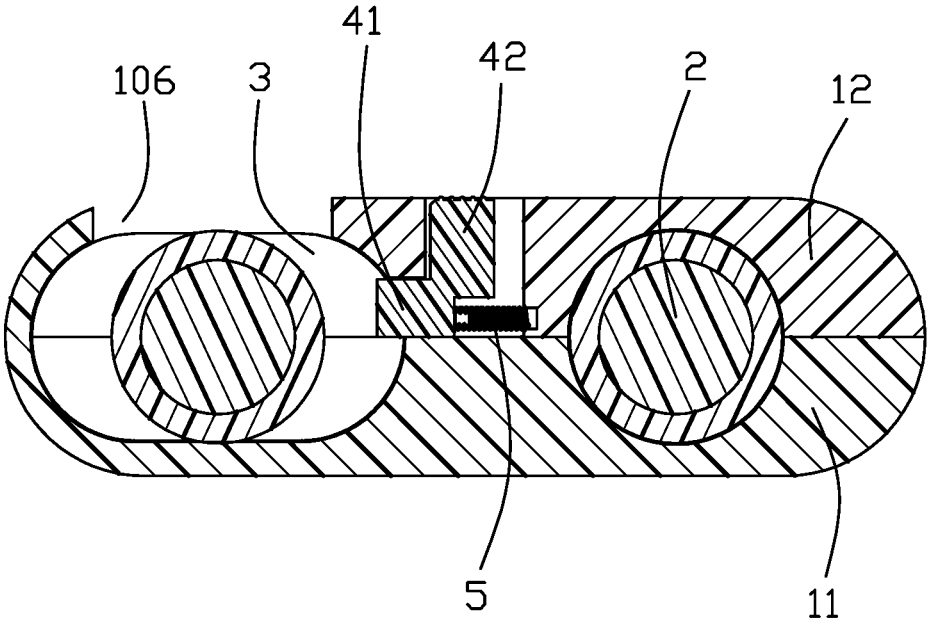
FIG. 7 is a cross section view of the connector module tacked along line 7-7 of FIG. 1.
Figure 8:
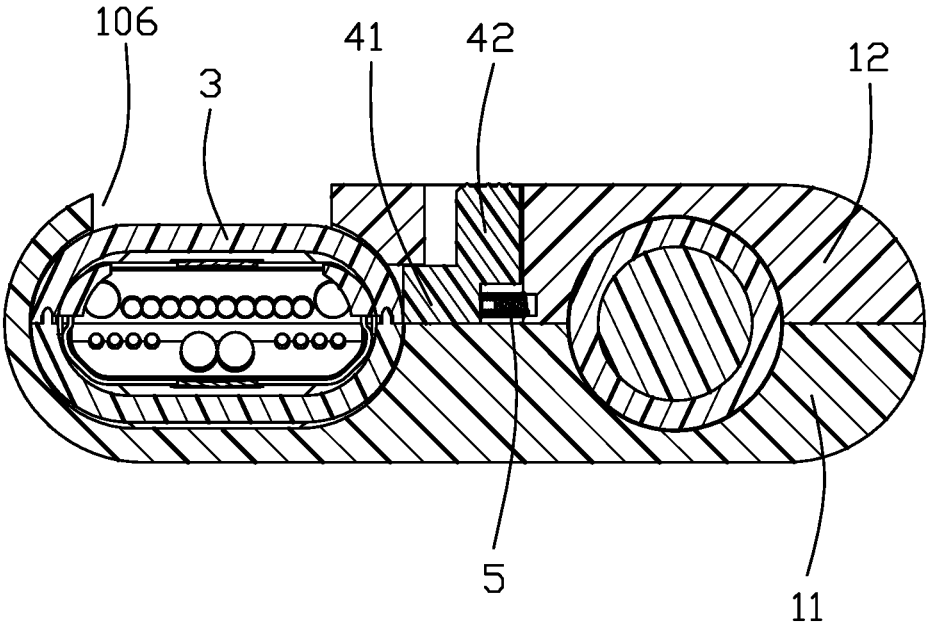
FIG. 8 is a cross section view of a block member of the connector module being driven out of a mounting slot of the connector module as shown in FIG. 1.
Figure 9:
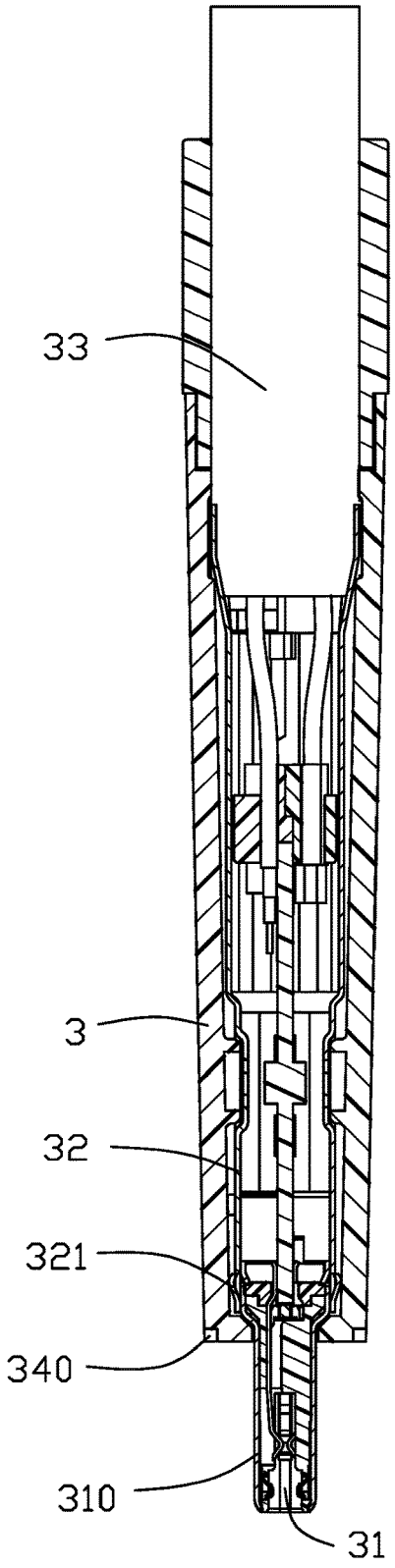
FIG. 9 is a cross section view of a second connector assembly of the connector module taken along line 9-9 of FIG. 2.
Figure 9A:
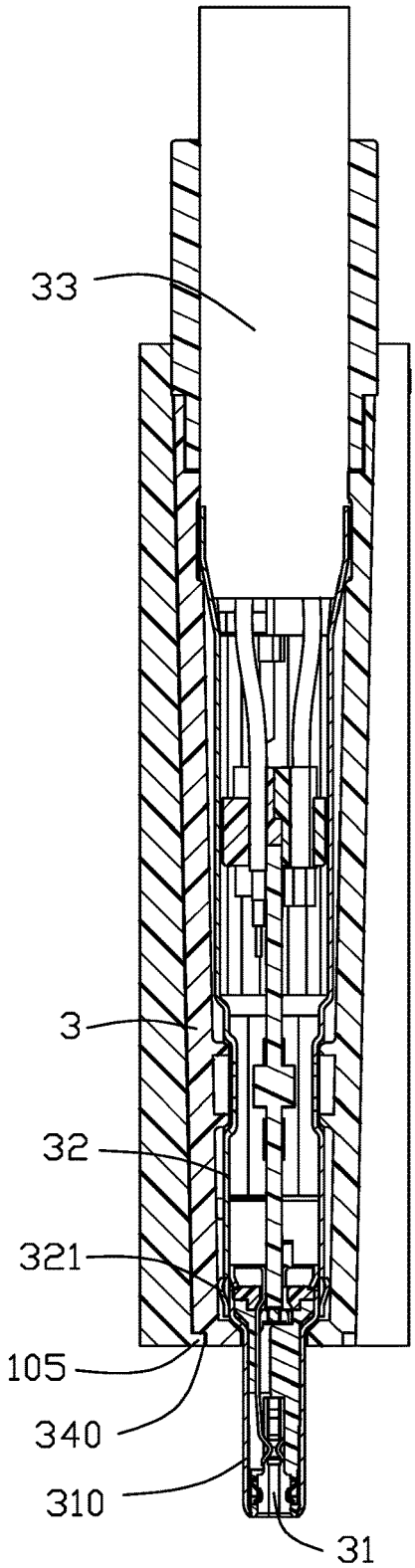
FIG. 9(A) is a cross-sectional view of the contact module including the second connector assembly as shown in FIG. 1.
Figure 10:
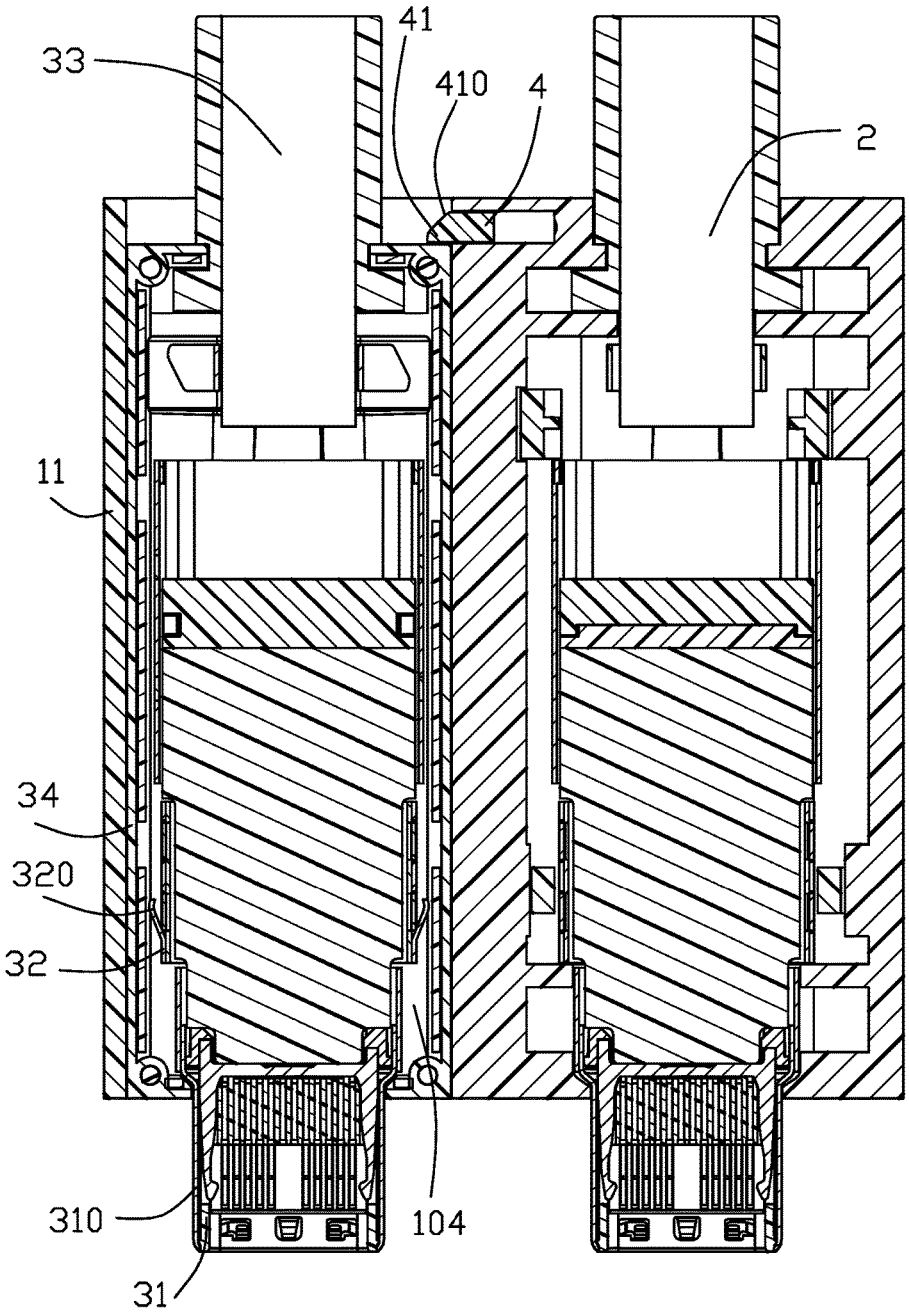
FIG. 10 is a cross section view of the connector module tacked along line 10-10 of FIG. 1.

Referring to FIGS. 1 to 10, a connector module 100 comprises a base 1, a first connector assembly 2 mounted on the base 1, a second connector assembly 3 mounted on the base 1, a block member 4 mounted on the base 1, and a spring member 5 received in the base 1 and cooperated with the block member 4. Both of the first connector assembly 2 and the second connector assembly 3 extend forwardly beyond the base 1 for mating with a mating connector. In this embodiment, the spring member 5 is coil spring. When the second connector assembly 3 is fully inserted into the base, a portion of the block member 4 is blocked at a rear of the second connector assembly 3 to prevent the second connector withdraw from the base 1. The first connector assembly 2 is fixed on the base 1, and the second connector 3 is floating with the base 1.

The base 1 comprises a front face 101, a rear face 102 opposite to the front face 101, a top face 103 connecting the front face 101 and the rear face 102, a mounting slot 104 extending through the front face 101 and the rear face 102, and a projection portion 105 formed on a front portion of the mounting slot 104. The base 1 comprises a lower portion 11 and an upper portion or cover 12 mated with the lower portion 11. The mounting slot 104 is defined on the lower portion 11. The mounting slot 104 upwardly extends through the top surface 103 and forms an opening 106 in the top face 103 to increase a tolerance of assembling the second connector assembly 3 to the base 1. The lower portion 11 defines a receiving room 110 for receiving the first connector assembly 2, and a receiving cavity 111 for receiving the block member 4. The upper portion 12 defines a through hole 120. After the first connector assembly 2 is received in the receiving room 110, the first connector assembly is fixed in the base 1.

The second connector assembly 3 is mounted on the base 1 through the mounting slot 104 along a rear to front direction, and extending beyond the front face 101 of the base 1 for being mated with the mating connector. The opening 106 of the base 1 has a width smaller than a width of a portion of the second connector assembly 3 received in the mounting slot 104. The second connector assembly 3 comprises a mating portion 31, a metal shell 32 enclosing a portion of the mating portion 31, a cable 33 electrical connected with the mating portion 31, and an outer shell 34 mounted on the metal shell 32 enclosing a portion of the mating portion 31 and a portion of the cable 31. The metal shell 32 comprises a pair of first spring members 320 are disposed between the metal shell 32 and the outer shell 34 to provide a left and a right floating space for the second connector assembly 3. The first spring members 320 are respectively integrated on a rear side and a right side of the metal shell 32 and extending outwardly and rearwardly therefrom. The metal shell 32 comprises a pair of second spring members 321 are disposed between the metal shell 32 and the outer shell 34 to provide an upper and a down floating space for the second connector assembly 3. The second spring members 321 are respectively integrated on a top side and a bottom side of the metal shell 32 and extending outwardly and rearwardly therefrom. The mating portion 31 comprises a mating shell 310 mated with the metal shell 32. The outer shell 34 defines a pair of recesses 340 in a front end and respective in an upper side and a lower side thereof.

The block member 4 comprises a block portion 41 extending into the mounting slot 104, and an operation portion 42 extending beyond the base 1 from the through hole 120 and exposed to an outer side of the base 1 for user to drive the block portion 41 withdraw from the mounting slot 104 to take out the second connector assembly 3 form the base 1. The block portion 41 comprises an inclined surface 410. When the second connector assembly 3 is inserted into the mounting slot 104 along the rear to front direction, the second connector assembly 3 is mated with the inclined surface 410 and pushing the block portion 41 out of the mounting slot 104 and to press the spring member 5. When the second connector assembly 3 is moved beyond the block portion 41, the spring member 5 push the block portion 41 moved into the mounting slot 104 and located at the rear end of the second connector assembly 3 to prevent the second connector assembly 3 withdraw from the base 1. The projection portion 105 can be mated with one of the recesses 340 to block the second connector assembly 3 forwardly moving. The projection portion 105 also can be mated with the other recess 340 to block the second connector assembly 3 forwardly moving, when the second connector 3 is inserted into the mounting slot 104 in inverse direction.

According to the present invention, the second connector assembly 3 is easily mounted on or detached from the base 1 through the block member 4 and the spring member 5. Therefore, the second connector assembly 3 can be used independently or together with the first connector assembly 1 that increase the variations of use and having lower cost, easy to manufacture and assembly.

In brief, in the invention the base provides two receiving spaces in a side-by-side manner along a transverse direction wherein the first connector assembly 2 received within the corresponding receiving space, e.g., the receiving room 110, in an immovable manner, and the corresponding mating portion which is immoveable in the first connector assembly 2, is also snugly restrained in the corresponding front opening (not labeled) of the base 1 in an immoveable manner. Differently, the second connector assembly 3 is immovably received in the corresponding receiving space, e.g., the mounting slot 104, in an immoveable manner while the mating portion 31 is moveable with regard the outer shell 34 of the second connector assembly 3 so that even though the outer shell 34 of the second connector assembly 3 is received within the corresponding receiving space in an immovable manner, the mating portion 34 of the second connector assembly 3 is in a moveable/floating manner. Therefore, during using both the first connector assembly 2 and the second connector assembly 3 may be correctly mated with the complementary two receptacle connectors due to the floatability of the second connector assembly 3 even though the first connector assembly 2 is not floating. Notably, in this embodiment, the first connector assembly 2 without floatability may be of the regular/simple type while the second connector assembly 3 may require of a complex type to include the outer shell 34. Anyhow, both the first connector assembly 2 and the second connector assembly 3 may be used separately and independently with the corresponding receptacle connector. It is also noted that the receiving space for the first connector assembly 2 may be structured as the mounting slot 104 used for with the second connector assembly 3 as long as the contour of the second connector assembly 3 and the receiving space in the base 1 are configured to allow the first connector assembly 2 to be forwardly inserted into the receiving space and stopped by the projection portion 105 and locked by the retractable block 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector module comprising:

a base comprising a front face, a rear face opposite to the front face, a top face connecting the front face and the rear face, and a mounting slot extending through the front face and the rear face;

a first connector assembly mounted on the base;

a second connector assembly mounted on the base through the mounting slot along a rear to front direction, the second connector assembly extending beyond the front face for being mated with a mating connector; and a block member mounted on the base and having a block portion projected into the mounting slot to block a rear end of the second connector assembly to prevent the second connector assembly from withdrawing from the base; and a spring member received in the base and cooperated with the block member, the block portion comprising an inclined surface, wherein during inserting the second connector assembly into the mounting slot along the rear to front direction, the second connector assembly is mated with the inclined surface and pushes the block portion out of the mounting slot against the spring member, and when the second connector assembly is moved beyond the block portion, the spring member pushes the block portion to move into the mounting slot and be located at the rear end of the second connector assembly.

2. The connector module as recited in claim 1, wherein the block member comprises an operation portion extending beyond the base for actuating the block portion to withdraw from the mounting slot to take out the second connector assembly from the base.

3. The connector module as recited in claim 2, wherein the top surface of the base defines a through hole for exposing the operation portion to an outer side of the base.

4. The connector module as recited in claim 1, wherein the mounting slot defines an opening through the top face of the base to increase a tolerance of assembling the second connector assembly to the base.

5. The connector module as recited in claim 4, wherein the opening has a width smaller than a width of a portion of the second connector assembly received in the mounting slot.

6. The connector module as recited in claim 1, wherein the first connector assembly is fixed on the base, and the second connector assembly is floating with respect to the base.

7. The connector module as recited in claim 1, wherein the second connector assembly comprises a mating portion, a metal shell enclosing a portion of the mating portion, a cable electrically connected with the mating portion, and an outer shell mounted on the metal shell and enclosing a portion of the mating portion and a portion of the cable.

8. The connector module as recited in claim 7, wherein a pair of first spring members are disposed between the metal shell and the outer shell to provide a left and a right floating space for the second connector assembly.

9. The connector module as recited in claim 7, wherein a pair of second spring members are disposed between the metal shell and the outer shell to provide an upper and a lower floating space for the second connector assembly.

10. A connector module comprising:

a base comprising a first receiving space and a second receiving space side by side arranged with each other in a transverse direction;

a first connector assembly received within the first receiving space in an immovable manner and including a first mating portion forwardly protruding out of the base and immovable relative to the base; and a second connector assembly received within the second receiving space and including a second mating portion forwardly protruding out of the base; wherein the second connector assembly includes an outer shell snugly received within the second receiving space in an immoveable manner while said second mating portion of the second connector assembly is floatable with respect to the outer shell so as to have the second mating portion moveable relative to the base.

11. The connector module as claimed in claim 10, wherein said second connector assembly and the second receiving space are configured to allow the second connector assembly to be inserted into the second receiving space forwardly in a front-to-back direction perpendicular to the transverse direction.

12. The connector module as claimed in claim 11, wherein a projection portion and a retractable block are provide on the base to retain the second connector assembly in position without movement in the front-to-back direction.

13. The connector module as claimed in claim 11, wherein the second receiving space is configured not to allow the second connector assembly to move in a vertical direction perpendicular to the transverse direction.

14. The connector module as claimed in claim 10, wherein said first connector assembly and the first receiving space are configured to allow the first connector assembly to be loaded into the first receiving space in a vertical direction perpendicular to the transverse direction.

15. The connector module as claimed in claim 14, wherein said base further includes a cover to shield the first receiving space in the vertical direction.

16. The connector module as claimed in claim 10, wherein said second connector assembly is equipped with a plurality of spring members between the outer shell and a metal shell which encloses a portion of the mating portion.

17. A connector module comprising:

a base comprising a front face, a rear face opposite to the front face, a top face connecting the front face and the rear face, and a mounting slot extending through the front face and the rear face;

a first connector assembly mounted on the base;

a second connector assembly mounted on the base through the mounting slot along a rear to front direction, the second connector assembly extending beyond the front face for being mated with a mating connector; and a block member mounted on the base and having a block portion projected into the mounting slot to block a rear end of the second connector assembly to prevent the second connector assembly from withdrawing from the base; wherein the first connector assembly is fixed on the base, and the second connector assembly is floatable with respect to the base; and the second connector assembly comprises a mating portion, a metal shell enclosing a portion of the mating portion, a cable electrically connected with the mating portion, and an outer shell mounted on the metal shell and enclosing a portion of the mating portion and a portion of the cable.

18. The connector module as recited in claim 17, wherein a pair of first spring members are disposed between the metal shell and the outer shell to provide a left and a right floating space for the second connector assembly.

19. The connector module as recited in claim 18, wherein the first spring members are respectively integrated on a left side and a right side of the metal shell and extend outwardly and rearwardly therefrom.

20. The connector module as recited in claim 17, wherein a pair of second spring members are disposed between the metal shell and the outer shell to provide an upper and a lower floating space for the second connector assembly.

* * * * *